United States Patent [19]

Probst et al.

[11] Patent Number: 4,557,421

[45] Date of Patent: Dec. 10, 1985

[54] PAPER DISINTEGRATOR AND METHOD OF OPERATING SAME

[75] Inventors: Karl Probst, Solingen; Kurt Hüfken, Krefeld, both of Fed. Rep. of Germany

[73] Assignee: Lindemann Maschinenfabrik GmbH, Düsseldorf, Fed. Rep. of Germany

[21] Appl. No.: 445,692

[22] Filed: Dec. 1, 1982

[30] Foreign Application Priority Data

Dec. 2, 1981 [DE] Fed. Rep. of Germany ..... 3147634

[51] Int. Cl.[4] ..... B02C 13/286

[52] U.S. Cl. ..... 241/73; 241/285 B

[58] Field of Search ..... 241/73, 285 R, 285 A, 241/285 B, 236, 189 R

[56] References Cited

U.S. PATENT DOCUMENTS

| | | | |
|---|---|---|---|
| 3,480,214 | 11/1969 | Wageneder | 241/73 X |
| 4,009,836 | 3/1977 | Strom et al. | 241/73 |
| 4,151,960 | 5/1979 | Peterson, Jr. | 241/73 |
| 4,385,732 | 5/1983 | Williams | 241/236 |

FOREIGN PATENT DOCUMENTS

| | | |
|---|---|---|
| 704853 | 3/1941 | Fed. Rep. of Germany . |
| 2516014 | 4/1980 | Fed. Rep. of Germany . |
| 226888 | 1/1925 | United Kingdom . |

*Primary Examiner*—Mark Rosenbaum

*Attorney, Agent, or Firm*—Toren, McGeady, Stanger, Goldberg & Kiel

[57] ABSTRACT

A paper disintegrator comprising a rotor to be fed from above with material to be disintegrated and having a horizontal axis, and an outlet grating disposed beneath the rotor is to be improved in such a way that it can disintegrate material of varying types to a predetermined degree of fineness on each occasion with the most favorable possible efficiency and, with the rotor running, can also be rapidly adapted to changing requirements. The discharge grating consists of two halves, which substantially surround the lower rotor half and which can be pivoted laterally outwards within the casing about grating axes extending horizontally approximately at the level of the rotor axis.

2 Claims, 2 Drawing Figures

PAPER DISINTEGRATOR AND METHOD OF OPERATING SAME

BACKGROUND OF THE INVENTION

This invention relates to a paper disintegrator comprising a rotor with horizontal axis rotatably journalled in a housing with filling opening and equipped with disintegrating tools, and comprising a discharge grating disposed beneath the rotor and also a discharge opening of the housing associated with the discharge grating. It relates furthermore to a method of operating this paper disintegrator. A disintegrating machine of the foregoing type, which is intended for trash and other waste materials, is described in DE-AS No. 25 16 014. With the rotor there are associated, amongst other things, a non-permeable grinding track possessing ribs oriented approximately parallel to the rotor axis and a grinding grating permeable to disintegrated material. The grinding grating possessing grating bars approximately parallel to the axis can be travelled horizontally laterally out of the lower part of the housing on rails. During operation of the machine for disintegrating normal trash, the material is first centrifuged onto an impact or rebound device situated above the grinding track and, after the corresponding pre-disintegration, is further so disintegrated on the grinding track that it can fall through the grinding grating. The grinding track and the grinding grating here surround substantially the lower half of the rotor in the aforementioned sequence. Whereas the grinding grating is intended to have a generally uniform distance from the beater circle of the rotor tools, it is intended to cause the distance between grinding track and rotor to become smaller in the rotor rotational direction. If hard objects which cannot be disintegrated are present in the material being treated, the grinding track can be temporarily swung away from the rotor.

The machine known from DE-AS No. 25 16 014 can also be used for disintegrating coarse material, such as bulky trash or rubbish, and indeed for disintegrating tough material, such as old tires. In the first mentioned case the disintegrating takes place substantially by the impact or rebound track, while the grinding grating is travelled entirely out of range of action of the rotor. The grinding track should here be disposed just sufficiently far from the beater circle of the rotor that a further granulation is carried out to a certain extent but there is no risk of jamming the machine. If, by contrast, old tires or similar tough material is to be processed, then grinding track and grinding grating are entirely removed or swung out from the range of action of the rotor and the rotor tools are brought into engagement solely with a shredder comb or with an anvil edge. For the last-named case, the rotational direction of the rotor of the known machine must be reversed. This changeover requires, however, a time consuming and energy consuming braking of the rapidly revolving rotor, revolving e.g. at 1500 rpm. Stopping of the rotor will also be necessary if the grinding grating has been moved out of the working position or been brought back into this position. Finally, a substantial disadvantage of the known machine lies in the fact that the grinding grating, when in its position moved out away from the operating position, interferes with the removal of the disintegrated material.

From the periodical "Zement-Kalk-Gips" ("Cement-Lime-Gypsum"), year 18 (1965), Vol. 11, Page 6, an impact pulverizer intended for granulating limestone and the like and having gratings in the lower part is also known. During maintenance, the grating can be withdrawn in the manner of drawers from the lower part of the impact pulverizer. During operation also, it is possible for one half of the grating basket to be pushed away from the rotor to provide an outlet gap. For reasons of space within the machine, however, only very small displacements of the grating basket halves which are divided approximately in the vertical plane through the rotor axis, can be carried out in the described example of construction. If, for example, the first grating half in the rotor rotational direction is pushed away somewhat from the rotor while the machine is operating, then a working zone converging in circular form between rotor and grating results, in which, if the machine is used for disintegrating normal trash or paper, the material increasing notably in volume during processing would become compacted and jam. If, by contrast or in addition, the second grating basket half in the rotational direction is pressed somewhat away from the beater circle of the rotor tools, then certainly a diverging wedge is produced between the rotor and the grating, but the material leaving the first grating does not even arrive in this diverging wedge but becomes jammed before the moved back second grating. The known machine is therefore unsuitable in its basic conception for disintegrating trash, paper and similar light material.

Paper disintegrators must be equally suitable for shredding individual sheets of paper, more or less large bundled stacks, entire files of documents and even material delivered in sacks. Widely varying requirements may be imposed in regard to the degree of disintegration, depending upon the type of input material. Relatively coarse disintegration is sufficient, for example, if it is only a matter of supplying the paper for further processing. In many cases smooth paper only has to be processed so that it can be pressed. Stringent requirements in regard to fineness of disintegration are, however, demanded in the destroying of secret or personnel files. The more finely the material has to be disintegrated, the greater is the time and energy required for the disintegration work. It is therefore of interest to be able to adapt the machine to the particular requirements rapidly and with the rotor still running. This is particularly so where fairly small batches of material of different types have to be processed one after another. To satisfy these requirements, it has hitherto frequently been the practice to use three shredders one after another, thus processing the material fed in by steps to the final desired state.

In paper shredders, a serious problem resulting from the low specific density of the paper shreds arises in so guiding the air in the machine that disintegrated material is blown or sucked towards the machine outlet. A feature counteracting this is that the rotor, due to its high rotational speed, generates an increased pressure on the front face (as viewed in the rotational direction) of fixed tools mounted in the beater circle of the rotor tools and a corresponding suction on the rear face of the fixed tools, as compared with ambient pressure. As a consequence pressure conditions can arise in the machine which lead to the charged material being carried immediately outwards again by an air stream oriented from the inside outwards in the inlet opening of the machine. At least it is frequently difficult to bring paper from the filling shaft of the machine into the range of action of the rotor tools.

These problems become still further intensified if, in order to achieve a uniform paper disintegration, gratings are disposed on the lower side of the rotor. This is because at the high rotational speed of the rotor the gratings can act almost like a closed plate, so that even sufficiently disintegrated paper does not fall through the grating. In practice it has therefore become usual to mount a powerful blower in the outlet of the machine, which sucks the disintegrated material through the processing range of the rotor. Since the efficiency of the machine is a function of the throughput of disintegrated material per unit of time and energy consumed, the extraction blower should only be brought into operation when this is absolutely necessary.

SUMMARY OF THE INVENTION

The task underlying the present invention is so to improve the initially named paper disintegrator that it can disintegrate material of varying types to a predetermined fineness for each occasion with the most favourable possible efficiency as determined from energy consumption, time required and fineness of the disintegrated material and can be correspondingly converted or adapted to the requirements while the rotor is running. In the paper disintegrator, with a rotor having a horizontal axis and charged from above with the material to be disintegrated and comprising a grating disposed beneath the rotor, the solution according to this invention consists in that the lower rotor half is substantially surrounded by a discharge grating divided approximately in the vertical plane through the rotor axis and that the grating halves can be pivoted laterally outwards about grating axes parallel to the rotor axis. Furthermore, the solution according to this invention for the method of operating the paper disintegrator consists in that, for fine disintegrating, both grating halves are brought into the working position at the beater circle of the rotor tools, that with coarse material and/or coarser shredding, the second grating half in the rotational direction is first pivoted outwards, and that for still coarser pieces of material and/or still less fine shredding, the first grating half is swung away, especially gradually, for example by steps, from the beater circle of the rotor tools.

By the invention the result is achieved that the paper disintegrator, with the rotor still running - and the rotor may for example have a run down time of half an hour - can be adapted with few operations to all the requirements regarding fineness of the disintegrated material produced, processing time and least possible energy consumption to the widest variety of papers to be charged into the machine. By means of the paper disintegrator of this invention, therefore, even fairly small batches of different types can be economically processed one after another.

As soon as both grating halves have been brought up to the beater circle of the rotor tools, secret documents and even bank notes can be effectively destroyed by the machine. In this case, however, a suction blower needs to be connected to the outlet from the casing in order to achieve an adequate performance. If the requirements regarding fineness of the shreds produced are less stringent, then the second grating half in the rotational direction can be swung fully out of the range of action of the rotor tools, so that the disintegrated material flows tangentially, that is approximately horizontally, off the first grating half which is still in use. Since the second grating half, when swung outwards, is also raised, it does not impede the outflow of the disintegrated material. With the second grating half swung outwards, the air stream otherwise existing at the rotor periphery sweeps off the end of the first grating half and the rotor itself produces in the machine the desired air flow for sucking in material to be disintegrated and for discharging the shreds produced. As a rule, therefore, as soon as one grating half has been swung outwards a suction blower is no longer required on the outlet side.

According to further features of the invention, the first grating half in the rotational direction of the rotor can be arrested at various pivoted positions relative to the beater circle of the rotor tools. The relative position of counter-tools mounted on the grating can here be adjusted according to the pivoted position of the grating halves relative to the beater circle of the rotor tools. By the stepwise or continuous adjusting of the first grating half in various pivoted positions, it becomes possible to process increasingly coarse material or to produce increasingly coarse shreds. A further favourable feature is that, when the first grating half is swung outwards, a wedge diverging in the rotational direction results between grating and rotor. Such a diverging wedge is very favourable for the paper which increases drastically in volume during processing. If, finally, the first grating half has been swung outwards entirely out of the range of action at the beater circle of the rotor tools, practically no shredding effect would any longer be produced without the introduction of additional tools. The machine of this invention possesses, therefore, in front of the inlet to the first grating half, a shredder comb or an anvil edge, which can be moved or swung in as desired into the range of action of the beater circle of the rotor tools. Finally, it may be pointed out that the ease of pivoting the grating halves outwards can also be utilized for releasing hard or jamming components or the like by temporarily outward swinging of the gratings. Whereas, in this temporary outward swinging of the grating halves, no special changes at the gratings themselves are carried out, it may however be advantageous, with a gradual lifting of the first grating half, to bring countertools provided at this grating half nearer to the beater circle of the rotor tools according to the degree of lifting off of the grating half.

BRIEF DESCRIPTION OF THE DRAWING

Further details of the invention are explained with reference to the diagrammatic representation of an example of embodiment shown in the drawing. The drawing shows.

DETAILED DESCRIPTION OF THE INVENTION

Figure 1:
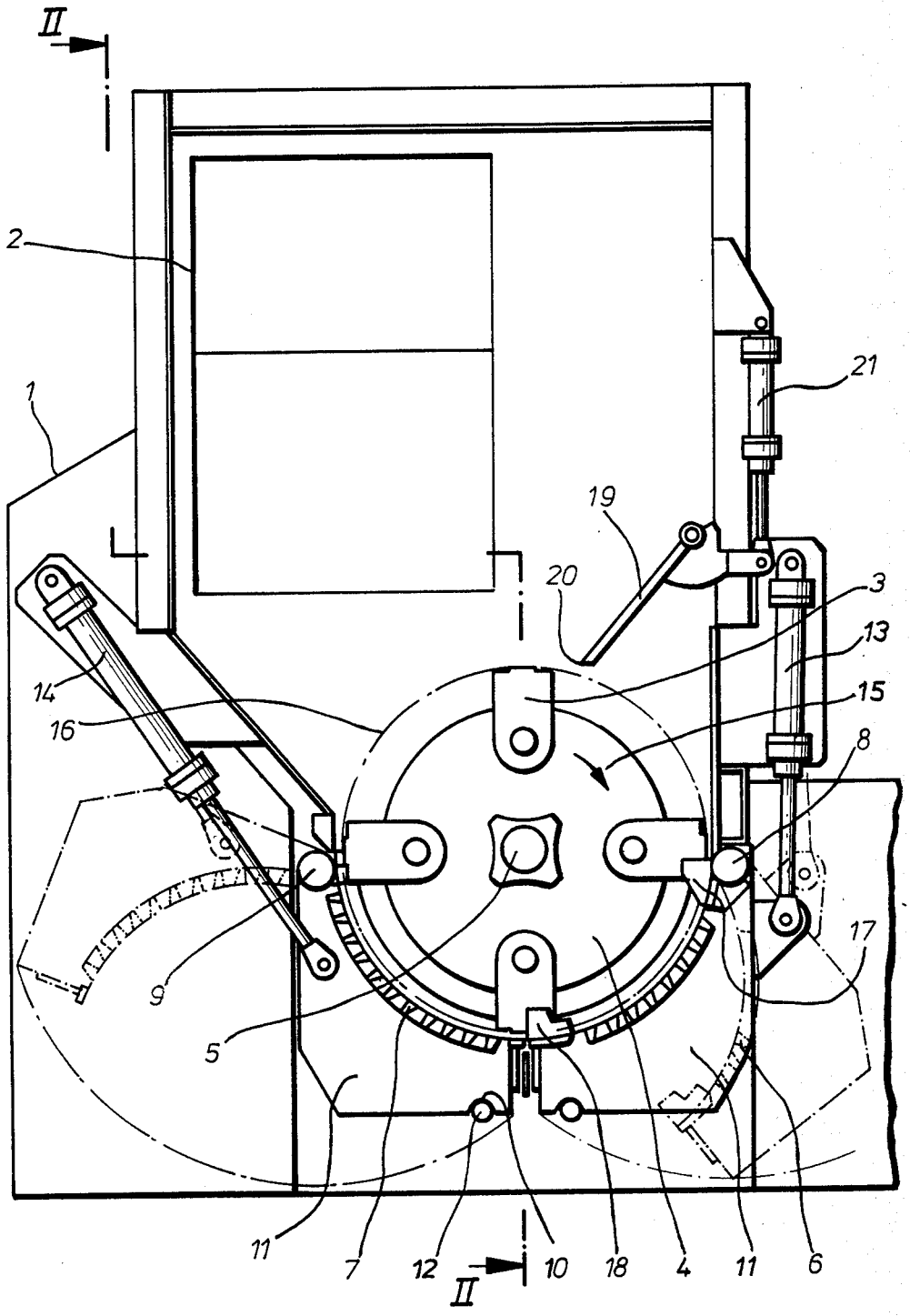
FIG. 1 a section through a paper disintegrator along the line I—I in FIG. 2.
Figure 2:
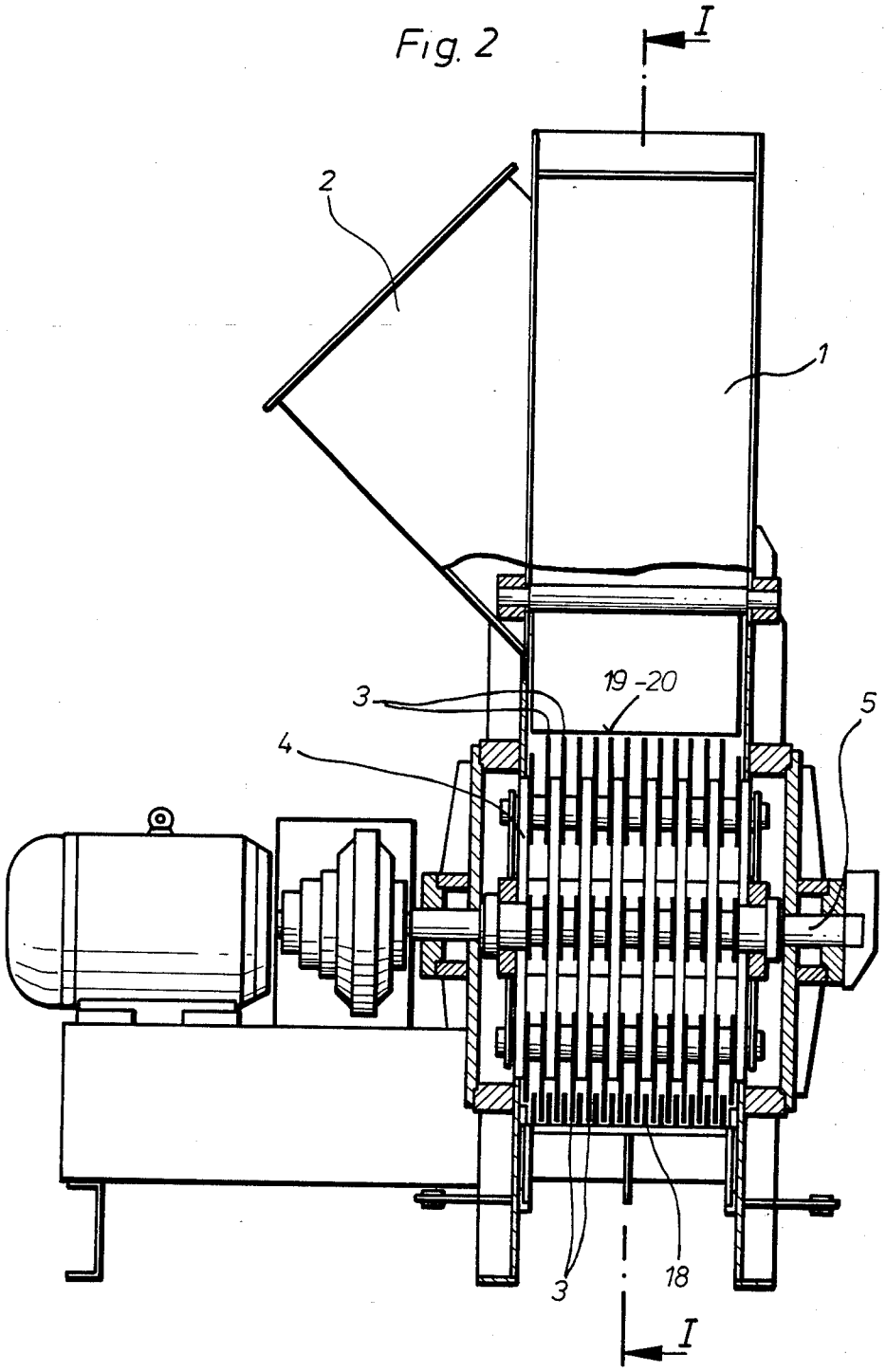
FIG. 2 a section along the line II—II through the paper disintegrator according to FIG. 1.

The paper disintegrator of this invention comprises a rotor 4 with horizontal axis 5, revolving rapidly in operation in a housing 1 with filling opening 2 and equipped with disintegrator tools 3 and to be charged from above with the material to be disintegrated, and a discharge grating disposed beneath the rotor 4 and consisting of two grating halves 6 and 7, and also a discharge opening of the housing 1 following thereafter. The grating halves 6 and 7 are divided approximately in the vertical plane through the rotor axis 5 and surround substantially the lower half of the rotor. Furthermore, the grating halves 6 and 7 can be pivoted laterally outwards about grating axes 8 and 9 horizontally journalled approximately at the level of the rotor axis 5. Undesired pivoting out of the grating halves 6 and 7 is prevented, in this embodiment, by locking bolts 12, engaging in grooves 10 of the cheeks 11 which mount the grating halves 6 and 7. For the intentional pivoting out and away of the grating halves 6 and 7, hydraulic piston-cylinder units 13 and 14 are provided, which act upon the cheeks 11 of the grating halves 6 and 7. The hydraulic device 14 for lifting the second grating half 7 in the rotor rotational direction 15 is here so constructed that this grating half together with its cheek plate 11, when swung outwards, moves along the indicated pivoting circle entirely out of the range of the lower horizontal tangent to the beater circle 16 of the rotor tools 3 into the position shown in dot-and-dash line. The second grating half 7 should here be raised sufficiently far above the aforementioned horizontal tangent that, with the first grating half 6 in operation, material thrown horizontally from the rotor 4 and grating half 6 does not strike the second grating half 7. The first grating half 6 in the rotational direction 15 therefore does not need, by contrast, to be swung by means of its hydraulic assembly 13 (along the indicated pivot line) so far as the second grating half 7, but need only be swung into the position shown in dot-and-dash line, since when the first grating half 7 is raised the disintegrated material falls only into the region of the vertical tangent adjacent to it to the beater circle 16.

Whereas the second grating half 7 in the rotational direction 15 is intended to be pivoted only either entirely up to the beater circle 16 or completely away from this circle, the first grating half 6 in the rotational direction 15 can fulfil useful functions in various intermediate positions. In the intermediate positions it may be favourable to raise or to lower the counter-tools 17 and 18 associated with the grating half 6, at least where permanent operation is intended, according to the distance from the beater circle 16. If the first grating half 6 in the rotational direction 15 is swung partly or entirely out of the range of action of the beater circle 16 of the rotor tools 3, further tools become necessary for disintegrating the charged material, for example an anvil blade 19, which can be brought or pivoted into the range of action of the beater circle 16. The material is then disintegrated between the rotor tools 3, for example pressed radially outwards by centrifugal force, and the anvil edge 20. A hydraulic cylinder-assembly 21 may also be provided for adjusting the anvil plate 19.

In order to make possible the adjusting and pivoting of the grating halves 6 and 7 including their associated cheek plates 11 while the rotor 4 is running, in accordance with the regulations for prevention of accidents, the housing 1 is also constructed sufficiently large in the lower region for the components that may be swung outwards still to have room inside the housing and for the operating person not to run the risk of injury by material thrown off the rotor during this pivoting operation.

We claim:

1. Paper disintegrator comprising a housing (1) having a filling opening (2), a rotor (4) rapidly rotatably journalled in said housing below said filling opening and having a horizontal rotor axis and equipped with disintegrator tools (3) having a beater circle (16) concentric with said horizontal rotor axis (5), said rotor arranged to rotate in a first direction, a discharge grating (6,7) in said housing disposed beneath the rotor (4) and a discharge opening for the housing (1) associated with the discharge grating (6,7), said rotor has a lower rotor half and the horizontal axis of said rotor is located in a vertical plane and in a horizontal plane disposed perpendicularly to the vertical plane with said lower rotor half located below and extending downwardly from the horizontal plane containing the horizontal axis of said rotor, said discharge grating substantially surrounding the lower rotor half, said discharge grating (6,7) is divided approximately in the vertical plane containing the rotor axis (5) into a first grating half and a second grating half each having a grating axis (8,9) extending parallel to the rotor axis (5) and located adjacent to the horizontal plane containing the rotor axis and spaced laterally outwardly from the vertical plane and on the opposite side thereof from the other grating axis, said first grating half located upstream from said second grating half relative to the rotation of said rotor in the first direction, means for individually and separably pivoting said first and second grating halves (6,7) laterally outwards about the grating axes (8,9), said means for pivoting can pivot the second grating half (7) between a first position adjacent to the beater circle in the range of said disintegrator tools and a second position completely out of the range of action of the disintegrator tools (3) to open a discharge path for disintegrated material coming approximately tangentially from the first grating half (6) as said rotor rotates rapidly so that a suction effect is afforded by the rapidly rotating said rotor, said means for pivoting can pivot the first grating half (6) outwardly from the beater circle for arresting said first grating half separately from said second grating half in various pivoted positions outwardly relative to and in cooperating relation with the beater circle (16) of the disintegrator tools (3),for varying the degree of disintegration of the paper and directing the disintegrated material through the discharge path formed by the second grating half in the second position, and the rotor (4) and the pivotal range of said first and second grating halves are enclosed by the housing (1) so that actuation of the grating halves (6,7) is admissible during continuous rotation of said rotor.

2. Paper disintegrator according to claim 1, characterized in that counter-tools are mounted on said first grating half and the relative position of said counter-tools (17,18) can be adjusted according to the position of pivoting of the grating half (6) relative to the beater circle (16) of the rotor tools (3).

* * * * *